US007651362B2

(12) United States Patent
Vianden

(10) Patent No.: US 7,651,362 B2
(45) Date of Patent: Jan. 26, 2010

(54) CONNECTOR ARRANGEMENT FOR PRINTED CIRCUIT BOARDS AND THE LIKE

(75) Inventor: Peter Vianden, Kalletal (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 12/080,890

(22) Filed: Apr. 7, 2008

(65) Prior Publication Data

US 2009/0117756 A1 May 7, 2009

(30) Foreign Application Priority Data

Apr. 11, 2007 (DE) ..... 20 2007 005 300 U

(51) Int. Cl.
*H01R 13/627* (2006.01)

(52) U.S. Cl. ..... 439/358

(58) Field of Classification Search ..... 439/358, 439/357, 353, 79

See application file for complete search history.

(56) References Cited

U.S. PATENT DOCUMENTS 4,640,566 A * 2/1987 Matsusaka ..... 439/350

6,217,365 B1 * 4/2001 Shinozaki ..... 439/358

FOREIGN PATENT DOCUMENTS

| | | |
|---|---|---|
| DE | 34 40 043 A1 | 5/1986 |
| DE | 295 13 997 U1 | 1/1996 |
| DE | 195 35 836 A1 | 3/1997 |
| DE | 202 01 609 | 7/2003 |

* cited by examiner

*Primary Examiner*—Phuong K Dinh
(74) *Attorney, Agent, or Firm*—Lawrence E. Laubscher, Sr.; Lawrence E. Laubscher, Jr.

(57) ABSTRACT

A connector arrangement serves to connect a plurality of the circuits of a printed circuit board with a plurality of electrical conductors, respectively, including a locking member for locking together a first connector member having terminals connected with the electrical conductors, respectively, and a second connector member having a plurality of conductive pins connected with the printed circuit board circuits, respectively. In a first embodiment, the locking pin is connected with the first connector member for longitudinal sliding displacement between unlocked and locked positions relative to a second connector member electrically connected with the first conductor member. Pairs of auxiliary contacts may be provided that are operable when the locking member is in the locked position. In a second embodiment, the locking member is pivotally connected with the first connector member for pivotal displacement between the unlocked and locked positions relative to the other connector member.

11 Claims, 4 Drawing Sheets

CONNECTOR ARRANGEMENT FOR PRINTED CIRCUIT BOARDS AND THE LIKE

BACKGROUND OF THE INVENTION

1. Field of the Invention

A connector arrangement serves to connect the circuits of a printed circuit board with a plurality of electrical conductors, respectively, including a locking member for locking a first connector member having terminals connected with the electrical conductors to a second connector member having a plurality of pins connected with the printed circuit board circuits, respectively.

2. Description of Related Art

Electrical connector arrangements with locking means are know in the art, as evidenced by the German Patent Nos. DE 202 01 609 U1, which was assigned to the same assignee as the present invention, DE 195 35 836 A1, G93 11 457.5, DE 295 13 997 U1 and DE 34 40 043.

The typical state of the art has proved itself. But it is desirable further to optimize the connector structure with regard to its structure, especially its compactness and its functional nature.

SUMMARY OF THE INVENTION

Accordingly, a primary object of the present invention is to provide apparatus for respectively connecting a plurality of electrical conductors to the electrical circuits on a printed circuit board, including locking means for locking together in the electrically engaged condition a pair of plug and socket connector members one of which is electrically connected with and mounted on the printed circuit board, wherein the locking means includes a manually-operable locking member arranged within the transverse rows of contacts on the adjacent faces of the connector members.

According to a more specific object of the invention, the locking means includes a locking member that is longitudinally slidably displaceable from an unlocked position to a locked position relative to the electrically engaged pair of connector members, said locking member being operable, when in the locked position, to activate a pair of auxiliary contacts. In a first embodiment, the auxiliary contacts are carried by the locking member and by one of the plug and socket connector members. In a second embodiment, the auxiliary contacts in include an electromagnetically-responsive reed contact. In a third embodiment, the locking member includes an axial protrusion that extends from the locking member to operate a pair of resilient contacts carried by one of the connector members. In a further embodiment, the auxiliary contacts may include a light-conductive member that is visible through an opening contained in one of the connector members.

In accordance with another embodiment of the invention, the locking member is pivotally connected intermediate its ends on one of the connector members and includes a resilient first end portion that is pivotally operable between locked and unlocked positions relative to the other connector member when the connector members are in the electrically engaged connected condition.

The present invention creates a connector arrangement, especially a printed circuit board arrangement with plug and socket connector members whereby one of the connectors is preferably is a socket part, while the other one of the connectors is a pin part as well as with at least one locking device, which, in a locking position, secures the two mutually coupled-together connector members against unintentional separation, and where one holding device of the second connector is movable, especially axially displaceable and/or pivotally displaceable, whereby the connector parts in each case preferably have several contacts that are arranged at least in one row and that are to be connected with each other in the area of their plug-in faces and whereby the locking device and the retaining device in at least one row of mutual contacts to be connected in each case is arranged between two of the contacts.

Preferably, the locking device is made as a slidably displaceable locking member, which in a locking position secures the two mutually coupled-together connector bodies against unintentional separation. The locking member is slidably guided in a guide housing of the first connector and can be shifted for locking engagement into an insertion passage contained in the second connector. The locking member is located between a pair of contacts of the row of contacts of the first connector for sliding displacement longitudinally of the connector assembly.

Particularly advantageous are at least one locking slide and the guide housing of one connector member and the insertion guide passage on the second corresponding connector are in each case arranged in the middle of the row of the mutual contacts to be connected. In this way, it is even possible that only a single locking slide and only a single guide housing and only a single insertion duct will be provided on the patch plug parts.

The invention-based connector furthermore advantageously basically employs the simple structure of the locking means of the typical state of the art device shown in the German patent No. DE 202 01 609 U1, which offers an extremely simple intuitive and tool-less operation. Since the locking means is located between the connections, the number of locking devices can be reduced even to only one single one. The central, especially symmetrical (or asymmetrical), arrangement of at least one locking means in place of the marginal arrangement of the locking devices, as in the state of the art, makes it possible to do without a second locking device and to couple the connector parts together with each other only by means of one lock. In that way, one needs less structural space, while the functional nature remains the same, or this may even facilitate increased functional effectiveness with the same structural space. The operability is furthermore improved to the extent that the lock can be worked with only one hand. The locking device and/or one of the additional functional elements lie between two of the two contacts and are so arranged that it/they will interrupt the straight line L, which connects the two contacts adjoining to the locking device immediately with each other.

According to another modification, there is created a connector arrangement where, in the area of at least one locking device and/or holding device (especially in these devices), there are arranged additional mutually corresponding functional elements. Thus, in the area of the lock one houses additional functional elements, in particular, contacts that are coupled together by sticking the patch plug parts together and that are uncoupled or are moved into and out of the functional position.

In this way, one can solve yet another problem, which is to make better use of the structural space of the plug connector. This solution can be used, on the one hand, for connectors of the above-described kind with the "central" locking member. But it is also suitable for other connectors of the typical kind.

In the area—especially within of at least one of the locking members as the locking device and/or at least one of the pertinent insertion passages as the holding device—there are preferably arranged the additional, mutually corresponding functional elements.

According to a modification of this invention, the electrically conducting contacts that serve as functional elements are engaged and are separated from each other.

According to another modification, the light-conducting elements that serve as the functional elements are connected with each other and are separated from each other.

According to a third variant of this invention, elements that do not touch each other and that act by means of magnetic, capacitive or inductive fields are activated or deactivated by means of reed contacts or the like.

In this way, one can make optimum use of the structural space on the printed circuit board plug connector because the space, which is otherwise used only for the lock, can now be used for at least one or several additional functional elements, in particular, contacts.

According to a further variant of this invention, electromagnetic or electromechanical elements, serving as functional elements, for example, are engaged and separated from each other.

The typical designation of the present invention, which, however should not rule out a use in other applications, for example, as wall bushing in a unit or a conductor-conductor connection, which, for example, is mounted on a mounting rail. The invention, along with the exemplarily described combination consisting of a component for the connection of conductors and electrical circuits on the printed circuit board connection, also includes these and other variants of practical use. That includes, for example, the combinations, not described in any greater detail here, of two components with conductor connection for a so-called cable-to-cable connection or coupling or the combination of two components with printed circuit board connection for the connection of two printed circuit boards. All components can be executed in the plug-in area also in the inverted structural style (socket strip for soldered connection or pin strip for conductor connection) or hermaphrodite design.

According to yet another variant of this invention, electromechanically (magnetically/inductively or thermoelectrically) movable elements are so actuated that any loosening of the lock during this actuation time is not possible or can be effectively prevented.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figures 1A, 1B, 1C, 1D:
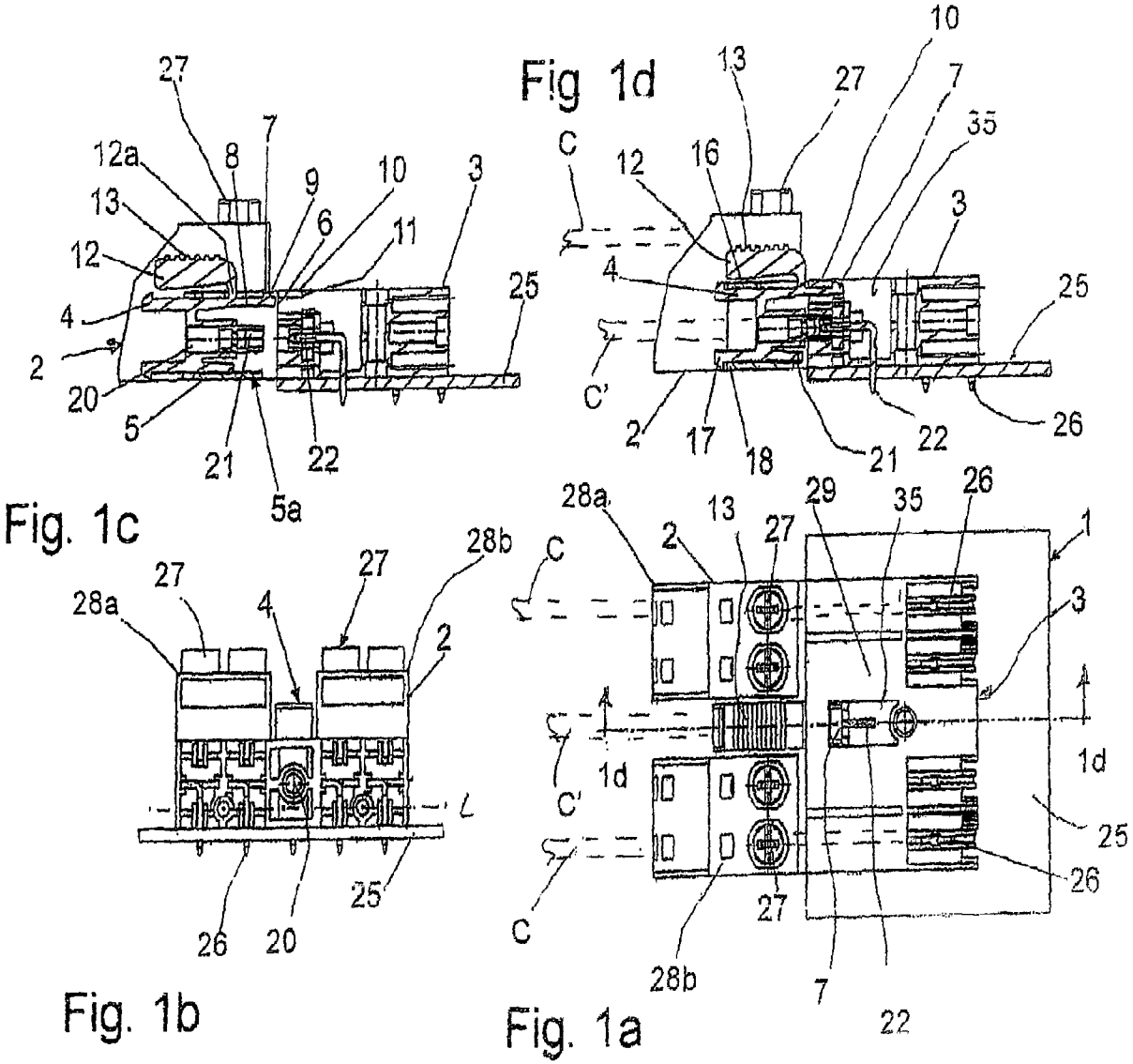
FIGS. 1*a* and 1*b* are top plan and left end views, respectively, of a first embodiment of the connector arrangement of the present invention when in the locked condition.
FIG. 1*c* is a longitudinal sectional view of the apparatus of FIG. 1*a* when in the unlocked condition.
FIG. 1*d* is a sectional view of the apparatus taken along line 1*d*-1*d* of FIG. 1*a;*
Figure 2D:
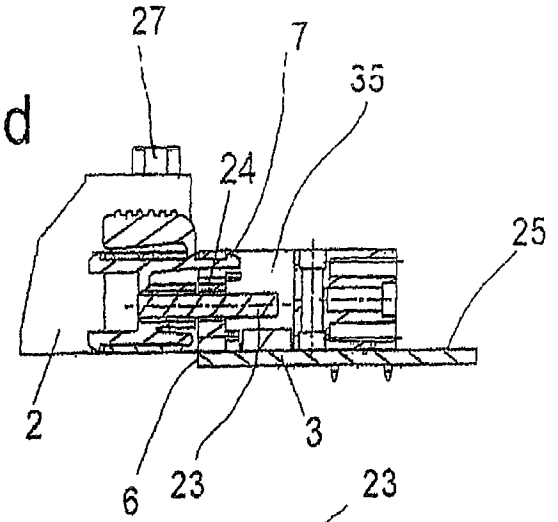
FIG. 2*d* is a sectional view taken along the line 2*d*-2*d* of FIG. 2*a;*
Figure 2A:
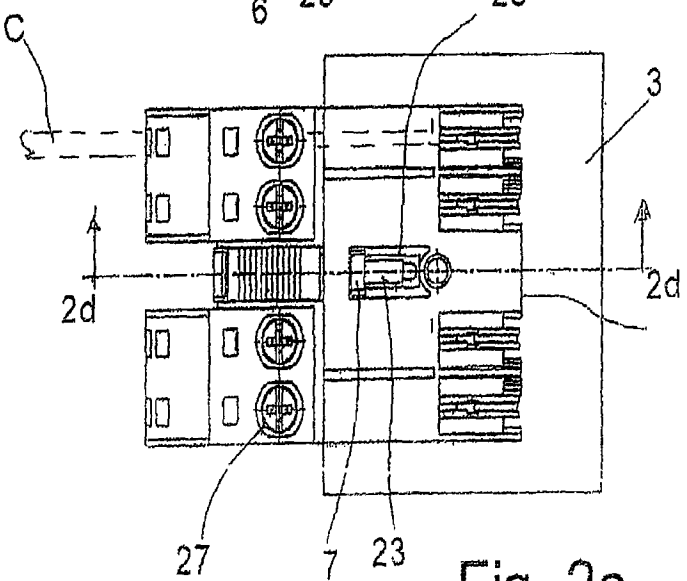
FIGS. 2*a* and 2*b* are top plan and left end views, respectively, of a second embodiment of the invention when in the locked condition.
Figure 2C:
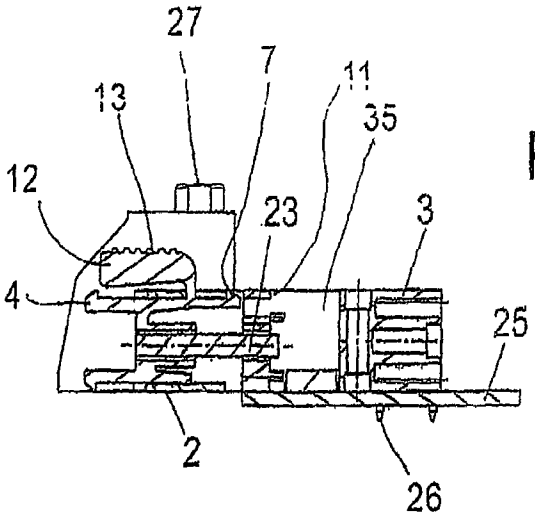
FIG. 2*c* is a longitudinal view of the apparatus of FIG. 2*a* when in the unlocked condition.
Figure 2B:
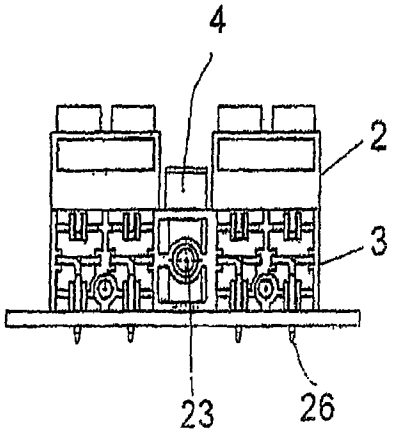
Figure 3D:
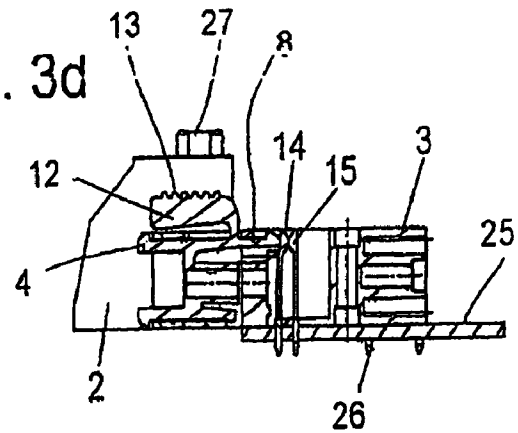
FIG. 3*d* is a sectional view taken along the line 3*d*-3*d* of FIG. 3*a;*
Figure 3A:
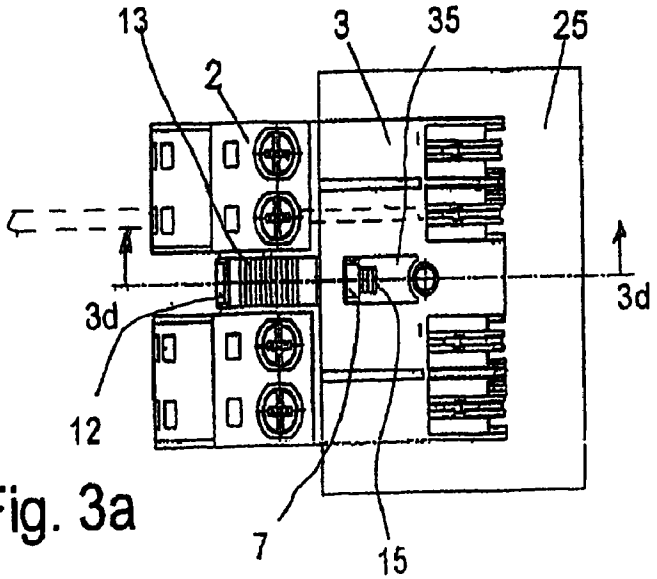
FIGS. 3*a* and 3*b* are top plan and left hand end views, respectively, of a third embodiment of the invention when in the locked condition.
Figure 3C:
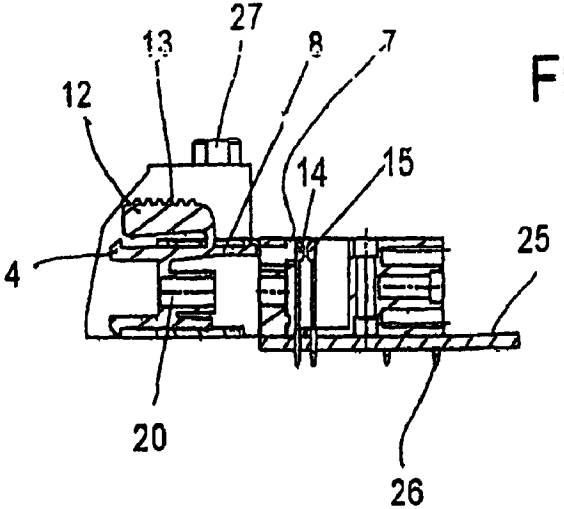
FIG. 3*c* is a longitudinal sectional view of the apparatus of FIG. 3*a* when in the locked condition.
Figure 3B:
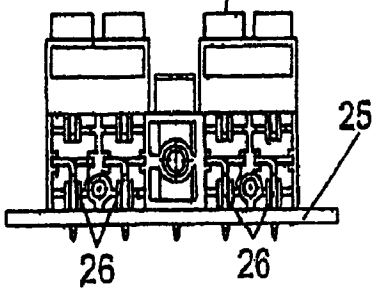

Referring first more particularly to FIGS. 1*a*-1*d*, the connected arrangement of the present invention includes a pair of socket and pug connector members 2 and 3 for respectively connecting a plurality of insulated conductors C to the electrical circuits on a circuit board 25. The plug connector 3 includes a transverse row of generally L-shaped conductive pin contacts 26 that extend at one end downwardly into engagement with the various electrical circuits carried by the printed circuit board, respectively. At their other ends, the pin contacts arc in electrical engagement with corresponding contacts on the socket connector member 2 that are respectively connected with the contacts of a transverse row of screw-type terminals 27 that are connected with the bare ends of the insulated conductors C. The plug and socket connector members have abutting surfaces contained in the transverse plane 6.

In accordance with a characterizing feature of the present invention, locking means including a locking member 4 are provided within the rows of pin contacts and terminals for connecting together the plug and socket connectors when in the electrically connected condition of FIGS. 1*a* and 1*d*. To this end, a guide housing 5 is rigidly secured between the socket connector portions 28*a* and 28*b* that each carries two of the screw terminals 27. The guide housing contains a first longitudinal passage 5*a* in which is slidably mounted the locking member 4. As shown in the drawings, the locking member is guided for longitudinal sliding movement in a direction parallel with the longitudinal axis of the plug and socket assembly. At one end, the locking member includes a resilient integral tongue portion 8 that protrudes in the direction of the housing 29 of the plug connector member 3. The locking member 4 extends within a second guide passage 10 defined in the adjacent end of the plug housing 29. The locking member is provided with an integral manual operating button portion 12 for displacing the locking member from its unlocked retracted position of FIG. 1*c* toward the locked position of FIG. 1*d*. As the locking member is displaced longitudinally toward this locked position, a locking hook or catch portion 7 having a cam surface 9 carried by the extremity of the resilient tongue 8 snaps upwardly behind the retaining edge 11 on the second guide passage 10, thereby to lock the socket connector member 2 to the plug connector member 3. To unlock the locking member, the button l2 is manually depressed to displace the locking hook or catch portion 7 downwardly out of engagement with the locking edge 11 on the housing 29.

According to another important feature of the invention, the locking member 5 is provided with a longitudinal through bore 20 in which is mounted a socket contact 21 that receives a stationary pin contact 22 that is mounted in the receiving guide passage 10 mounted on the adjacent end on the socket connector housing 29. The pin contact 22 is generally L-shaped and extends downwardly toward engagement with a given circuit on the printed circuit board 25. In this way, a signal may be transmitted to or from the circuit board when the locking member is in the locked position of FIG. 1*d*. The stationary pin contact 22 and the locking hook or catch portion 7 are visible via the housing opening 35 (FIG. 1*a*) when the apparatus is in the locked condition.

In a second embodiment of the invention shown in FIGS. 2*a*-2*d*, the locking member 4 carries an electromagnetically-operable reed contact 23 that extends through a corresponding passage contained in the housing of the plug contact member 3 adjacent a stationary contact 24. When the locking member 4 is in the locked condition of FIGS. 2*a* and 2*d*, and the locking catch 7 is in latched engagement with the housing locking edge 11, the end of the reed 23 is visible through the opening 35 contained in the housing 29. The functional elements 23, 24 of a reed contact consisting of magnetically actuated contacts, for example, on the printed circuit board or in the structural space of a flange and a permanent magnet in the mobile part of the locking device or vice versa.

As an alternative, it is also conceivable that one might use, as a functional element, a ram on the locking member 4, or one might use the locking member itself as a ram in order to engage two contacts such as metal sheets or pins 14, 15 on the corresponding connector member 3 (FIG. 3).

The locking member offers the further advantage that the locking state can be recognized optically by the position of the locking member 4 via the housing opening 35. The other functional elements, which are integrated into the locking means, in particular, also permit electrical monitoring of the locking function by means of a supervisory control and monitoring unit. It is also conceivable that one might indicate the state optically or acoustically, for example, with an LED directly on the plug connector. It is advantageous here that by means of the additional contacts, one can possibly get along without any separate additional cable connections because the connector provides additional integrated contacts, for example, for control purposes.

Here it is also conceivable, for example, that by means of multiple stocking of at least one contact chamber with at least two electrically and mutually separated auxiliary contacts, one might use at least one or the other (auxiliary) contact for other purposes, for example, as control contacts or as contacts for a data or power supply line, for example, of a bus to which also belongs the other contacts to be connected on the connector parts (on the connector parts when one possibly fashions additional connections to the printed circuit board or toward the outside, which can be designed in any technique such as pushpin or the like).

Locking member 4 is made here by way of example in one piece from a resilient elastic material, for example, a suitable synthetic plastic material. Similarly, the bodies of the connector members 2 and 3 are formed from a suitable electrical insulating material.

According to FIG. 4, the reference symbol 1 again designates the connector arrangement that consists of the first plug connector 2 and the second socket connector 3, whereby the two connectors 2 and 3 are secured against unintentional separation by a locking member 4' when in the coupled state.

Locking member 4' in FIG. 4 then again ensures a locking position (FIG. 4*c*) for the two mutually coupled-together connectors 2, 3 against unintentional separation and is movable into a holding device of the socket connector 3. The holding device is made as a catch edge 30 in the insertion passage 35 contained within the socket connector 3. The locking member 4' is arranged on the plug connector, for example, between two of the contacts. In this embodiment, the locking member 4' is not axially displaceable relative to the plug connector 2 as in the previous embodiments, but rather is connected for longitudinal displacement simultaneously with the plug connector 2, and is pivotally displaceable upon the latter about the fixed pivot axis 31. Again it has a resilient tongue 8' on whose free end there is a hook or catch portion 7' , which again preferably also has an inclined cam surface 9'.

Locking member 4' is furthermore pivotally connected intermediate its ends in an area spaced away from the catch hook via a pivot or bridge 31 integral with the plug connector 2. Molded upon the other end of the locking member 4' is furthermore an actuation button 12' that is so designed and arranged that by exerting pressure on the actuation button 12' normal to the plug-in direction X, the tongue 8' , with the catch portion or hook 7' , can be moved or swung essentially perpendicularly with respect to the plug-in direction X.

Figure 4A:
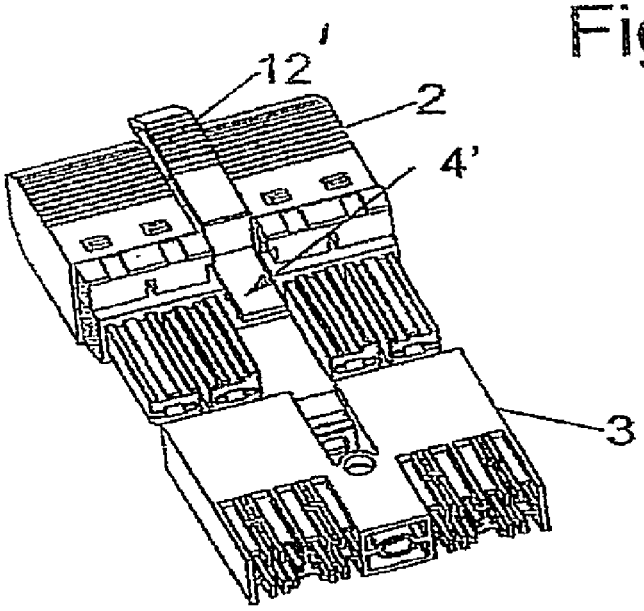
FIG. 4*a* is a top perspective view of a fourth embodiment of the connector arrangement of the present invention.
Figure 4B:
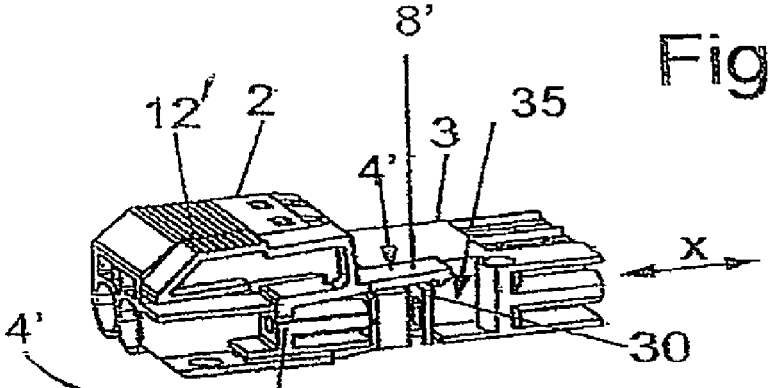
FIGS. 4*b*-4*d* are perspective sectioned side views illustrating the locking means of FIG. 4*a* in the partially connected, fully connected and fully released conditions, respectively.
Figure 4C:
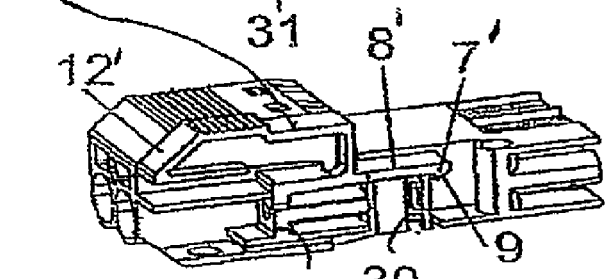
Figure 4D:
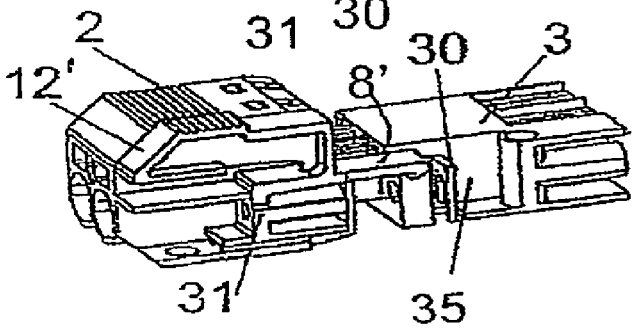

When the two plug connector parts 2, 3 (FIG. 4*a*) are pushed together, the inlet slope 9' first of all touches the catch edge 30, as a result of which. tongue 8 is swung out (FIG. 4*d*) until the catch cam 7', as the two patch plug parts 2 and 3 are further pushed together, finally undercuts the catch edge 30 in a catching manner. In this position, the two connector members 2, 3 are secured against being unintentionally pulled apart from each other (FIG. 4*c*).

By pressing upon the actuation button 12 (in accordanec with FIG. 4*b*), the tongue 8' with catch cam 7' can be swung out of the locking position so that the two connectors 2, 3 can again be separated from each other.

The additional optional functions shown in the above figures can also be implemented in this exemplary embodiment.

While in accordance with the provisions of the patent Statutes the preferred forms and embodiments of the invention have been illustrated and described, it will be apparent to those skilled in the art that changes may be made without deviating from the invention described above.

What is claimed is:

1. A connector arrangement for respectively connecting a plurality of electrical conductors (C) with a plurality of circuits on a printed circuit board (25), comprising:

(a) a printed circuit board (25) having a plurality of electrical circuits thereon;

(b) a pair of plug and socket connector members (2, 3) having colinear longitudinal axes, (1) one of said connector members including a transverse row of conductive pins (26) connected with said printed circuit board electrical circuits, respectively;

(2) the other of said connector members including a transverse row of terminals (27) adapted for connection with the electrical conductors, respectively;

(3) said plug and socket connector members having a connected condition in which abutting surfaces on said connector members are contained in a common plane (6) and said pins are connected with said terminals; and (c) locking means for locking together said connectors in said connected condition, said locking means being located within said rows of conductive pins and terminals, said locking means including a locking member (4') mounted on one of said connector members, said locking member having a longitudinal axis parallel with that of said one connector member, said locking member including:

(1) a pair of end portions, and an intermediate portion;

(2) said locking member intermediate portion being pivotally connected with said one connector member for pivotal movement about a fixed pivot axis (31) that extends transversely relative to said locking member longitudinal axis;

(3) a first one of said locking member end portions comprising a resilient tongue portion (8') extending into an insertion passage (35) contained in the adjacent end of the other one of said connector members, said tongue portion terminating in a catch portion (7') that is normally biased in one direction toward locked engagement with a transverse catch edge (30) arranged in said insertion passage;

(4) the other one of said locking member end portions having a manually operable button portion (12') extending outwardly from the associated connector member for pivoting said tongue portion in the opposite direction, thereby to release said catch portion from said catch edge, whereby connector members are unlocked for the longitudinal separation thereof.

2. A connector arrangement as defined in claim 1, wherein said locking means are centered within said rows of pins and terminals.

3. A connector arrangement as defined in claim 1, wherein said locking means includes a sliding locking member (4) connected for longitudinal sliding movement on a first one of said connector members (2) between locked and unlocked positions relative to the other one of said connector members.

4. A connector arrangement as defined in claim 3, and further including auxiliary contact means (21, 22; 23, 24; 14, 15) operable from a first condition to a second condition when said sliding locking member is in said locked position.

5. A connector arrangement as defined in claim 4, wherein said auxiliary contact means comprise a first auxiliary contact (21) mounted on said sliding locking member for engagement with a corresponding second auxiliary contact (22) carried by the other one of said connector members (3).

6. A connector arrangement as defined in claim 4, wherein said first auxiliary contact is an electromagnetically-operable vibratory reed contact (23) arranged for cooperation with a stationary second contact (24) carried by said other connector member.

7. A connector arrangement as defined in claim 4, wherein said first and second auxiliary contacts are resilient contacts (14, 15) mounted on said other connector for operation by said sliding locking member from a open condition to a closed condition.

8. A connector arrangement as defined in claim 4, wherein said first and second auxiliary contacts comprises light-conducting members.

9. A connector arrangement as defined in claim 5, wherein said sliding locking member contains a longitudinal through bore (20) in which said first auxiliary contact is mounted.

10. A connector arrangement as defined in claim 3, and further including stop catch means (17) limiting the extent of sliding displacement of said locking member toward said locked position.

11. A connector arrangement as defined in claim 1, wherein said resilient locking tongue catch portion (7') includes a cam surface (9) arranged to engage said locking edge during the connection of said correctors, thereby to deform said resilient tongue temporarily toward a position permitting said catch portion to extend behind said catch locking edge.

* * * * *